US006491548B2

(12) United States Patent
Stepniak et al.

(10) Patent No.: US 6,491,548 B2
(45) Date of Patent: Dec. 10, 2002

(54) ELBOW CANISTER FUSEHOLDER

(75) Inventors: Frank Stepniak, Andover, NJ (US); Anthony Reed, Port Murray, NJ (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/824,069

(22) Filed: Apr. 2, 2001

(65) Prior Publication Data

US 2001/0044242 A1 Nov. 22, 2001

Related U.S. Application Data

(60) Provisional application No. 60/194,458, filed on Apr. 4, 2000.

(51) Int. Cl.[7] ..... H01R 13/68; H01R 33/95; H01H 39/00

(52) U.S. Cl. ..... 439/622; 439/621; 337/202

(58) Field of Search ..... 439/622, 805, 439/801, 921, 621, 186, 187; 337/208, 209, 210, 211, 202

(56) References Cited

U.S. PATENT DOCUMENTS 3,686,603 A * 8/1972 Lockie et al. ..... 174/73.1
3,818,407 A * 6/1974 Edgerton ..... 337/199
5,114,357 A 5/1992 Luzzi ..... 439/183
5,421,750 A 6/1995 Crotty ..... 439/801
5,795,180 A 8/1998 Siebens ..... 439/489

OTHER PUBLICATIONS

Thomas & Betts, "FLR 15kV Fused Loadbreak Elbows", Bulletin B–1198A, 2 pages (undated).

EPOX Technology, "Series I Encapsulated Fuse", 2 pages, (undated).

Ermco Components, Inc. "Outline–Dry Well Fuseholder", 1 page, Jul. 8, 1987.

* cited by examiner

*Primary Examiner*—Brian Sircus
*Assistant Examiner*—Chandrika Prasad
(74) *Attorney, Agent, or Firm*—Hoffmann & Baron, LLP

(57) ABSTRACT

A new elbow canister fuseholder is provided that includes an electrically insulated and shielded housing for placing a fuse in-line between a cable and an electrical apparatus for underground distribution application. An insulating tube is contained within the housing for easy sliding removal of the fuse through an end plug such that the elbow is reusable when a fuse is replaced.

17 Claims, 1 Drawing Sheet

ELBOW CANISTER FUSEHOLDER

CROSS-REFERENCE TO RELATED APPLICATIONS

The present application claims priority to United States Provisional Patent Application Serial No. 60/194,458, filed Apr. 4, 2000.

FIELD OF THE INVENTION

The present invention relates to electrical elbows and, in particular, the present invention relates to an elbow canister fuseholder that allows for the simple replacement of fuses in electrical elbow applications.

BACKGROUND OF THE INVENTION

There are several ways of achieving an in-line fuse for underground application. One provides an insulated molded housing where the fuse is inserted, with interference, into rubber housing or is molded into epoxy housing. The disadvantage of the rubber housing is that the fuse change-out procedure is difficult to perform in the field.

Another application is to use an epoxy housing where the fuse is integral to the part, making the housing non-reusable after the fuse opens. A second type of epoxy housing, allows replacement of the fuse, but is large and bulky. In neither case does an epoxy type housing provide direct connection to a cable or apparatus without the use of additional connector components. Further, epoxy housings tend to fragment on failure, expelling hard pieces that can cause damage or injury, unlike rubber housings that split or rupture to release internal pressure, but stay intact.

Another application exists in the use of a dry well canister. This is a holder that requires additional insulation around the outside, such as oil or $SF_6$ gas. It is typically mounted in a tank filled with this insulating medium. It requires an auxiliary bushing mounted on the tank wall and additional connector components to provide connection between the fuse and the cable.

SUMMARY OF THE INVENTION

The present invention eliminates the above difficulties and disadvantages by providing a new elbow canister fuseholder comprising an electrically insulated and shielded housing for placing a fuse in-line between a cable and an electrical apparatus for underground distribution application. An insulating tube is contained within the housing for easy sliding removal of the fuse through an end plug opening such that the elbow is reusable when a fuse is replaced.

In accordance with a preferred arrangement of the invention, an elbow fuseholder comprises a housing including a generally elongate insulative sleeve defining at one end thereof a cable entrance for receipt of a cable therein, and at the opposing end a fuse entrance opening. An elbow interface is joined to the sleeve at an angle and defines a mating interface for electrical connection with an external bushing insert. A fuse is electrically connected at one end thereof to a conductor of a cable received in the sleeve and electrically connected at the other end thereof to the elbow mating interface. An insulative tube is disposed interiorly of the insulative sleeve, and slidably supports the fuse therein. In a particular form of the invention, the elbow fuseholder includes a plug disposed within the sleeve, the plug being detachably connected to the fuse at the elbow interface. As such, the fuse and plug are joined in an assembly that is removable from the tube through the fuse entrance opening.

DETAILED DESCRIPTION OF THE PREFERRED EMBODIMENT(S)

Figure 1:
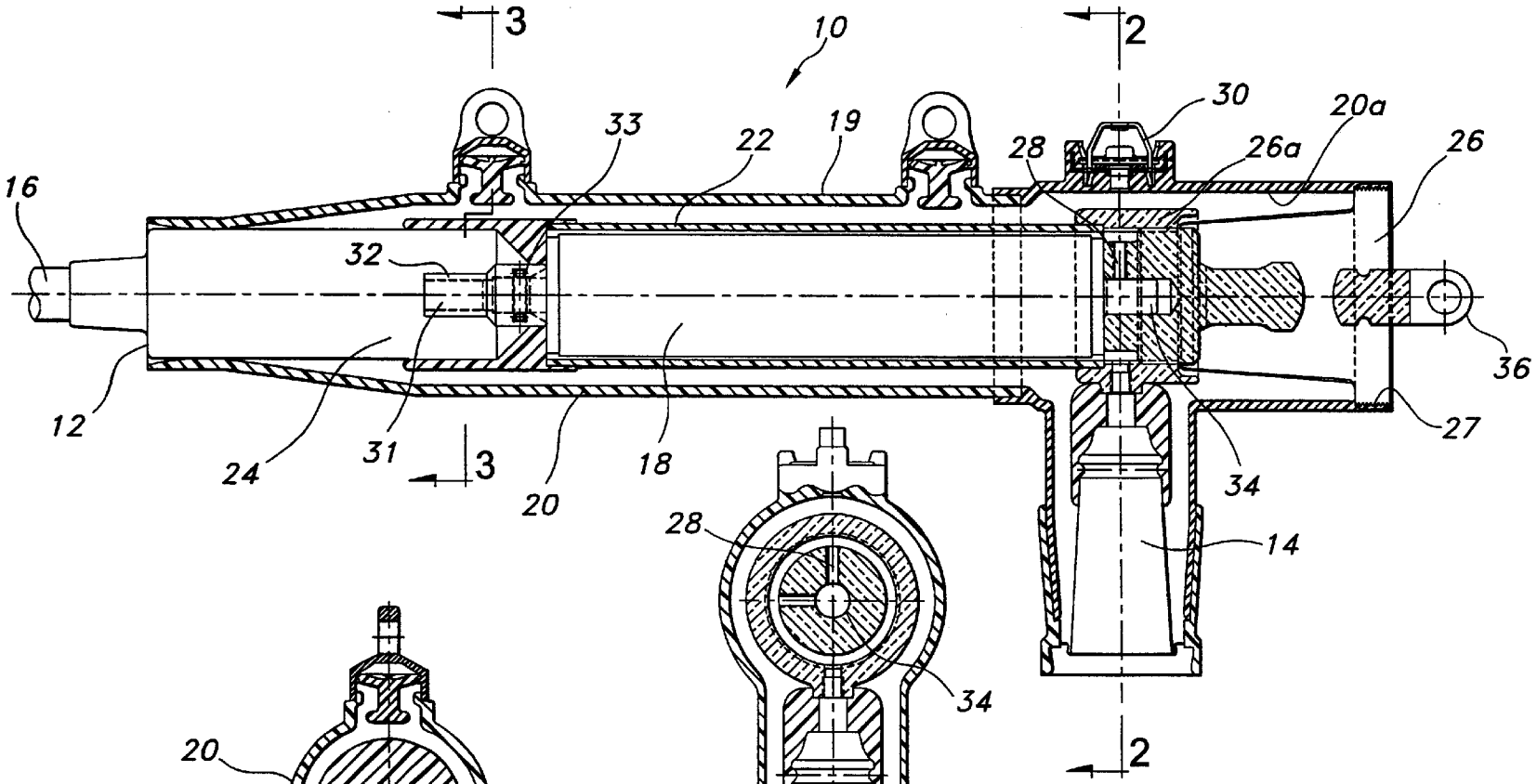
FIG. 1 is a cross-sectional view of an elbow canister fuseholder of the present invention.
Figure 2:
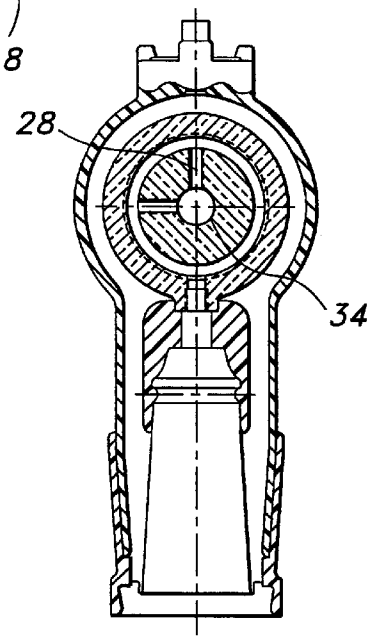
FIG. 2 is a cross-sectional view of the elbow interface, fuse, fuseholder and housing taken along sight line A—A of FIG. 1.
Figure 3:
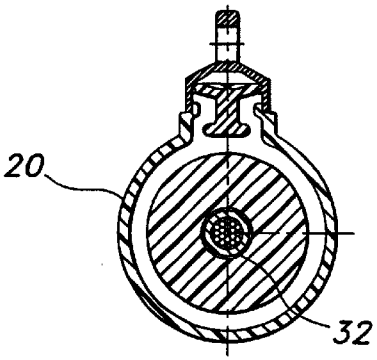
FIG. 3 is a cross-sectional view of a cable/fuse contact taken along sight line B—B of FIG. 1.

The above and other features, aspects, and advantages of the present invention will now be discussed in the following detailed description and appended claims, which are to be considered in conjunction with the accompanying drawings in which identical reference characters designate like elements throughout the views. Shown in FIG. 1 is an elbow canister fuseholder 10 providing a cable entrance 12 and an elbow interface 14 for mating with a suitable external bushing insert (not shown). It provides direct connection between a cable 16, a fuse 18 and apparatus bushing.

The design comprises a housing 19 defined by a molded rubber sleeve 20 with its mid-section inside diameter supported by a rigid insulating tube 22. One end of the rubber sleeve 20 is sized for a cable adapter 24 that has a size sensitive inner diameter to fit various cable diameters. The other end of the rubber sleeve 20 is fitted for a plug 26 that is removable, allowing access to the rigid tube.

The fuse 18 can pass through the plug opening 20*a* with clearance between the fuse outer diameter and the inner diameter of the rigid tube 22. The plug 26 is attached by its plug contact 26*a* to the fuse 18 by means of a setscrew 28, and the fuse/plug assembly can be inserted or removed by a live line tool connected to an eye 36 on the plug 26. The plug 26 is fixed to the rubber sleeve 20 by threads 27 in a metal contact molded into the sleeve 20 or held in place by an external clamp. The plug 26 provides a water and electrical seal with the sleeve 20.

The elbow interface 14, which is preferably integral to the rubber sleeve 20, provides a connection means for connecting an external bushing insert to the fuse 18. Elbow interface 14 is adapted to accommodate an external bushing insert whereby the external bushing insert may be electrically connected to the fuse ferrule 34 through plug contact 26*a* which is connected to fuse ferrule 34 by setscrew 28. At the other end of the fuse 18 fuse ferrule 31 is connected to the cable 16 through a female contact 32 that is crimped to the cable conductor at one end, and connected to the fuse ferrule 31 by means of an intermediary spring 33. There is a pulling eye 30 on the sleeve 20 that allows assembly to, and removal from, an external bushing insert with a live line tool.

The plug 26 can be releasably secured to the sleeve 20 by various means, including threads 27, twist lock, or external clamp.

Connection of the fuse ferrule 34 to the plug contact 26*a* can be via setscrews 28, elbow probe thread clamp, threads or any other adequate separable connection means that supports the weight of the fuse 18. The connection of the fuse ferrule 31 to the cable connector contact can be a garter springs, louver, pin and socket, or any other sliding connection that allows insertion and removal of the fuse.

The device is shown with a cable entrance and a 200A loadbreak elbow interface. Other interfaces can be used. A unit with two or more interfaces could be provided with or without the cable entrance.

The rubber sleeve 20 can be sized directly to the cable without the use of a cable adapter.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. The true scope of the invention is set forth in the claims appended hereto.

What is claimed is:

1. An elbow fuseholder, comprising:

a housing including a generally elongate insulative sleeve defining at one end thereof a cable entrance for receipt of a cable therein and at the opposing end a fuse entrance opening;

an elbow interface joined to said sleeve at an angle and defining a mating interface for electrical connection with an external bushing insert;

a fuse electrically connected at one end to a conductor of said cable received in said sleeve and electrically connected at another end to said elbow mating interface;

an insulating tube disposed interiorly of said insulative sleeve, said fuse being slidably supported interiorly therein, said tube being elongate and of length to extend substantially from the cable conductor connection to the elbow interface; and a plug removably supported by said insulative sleeve at said fuse entrance opening and affixed to said fuse adjacent said elbow mating interface, said plug and said fuse being jointly removable from said sleeve through said fuse opening upon removal of said plug from said sleeve.

2. An elbow fuseholder according to claim 1, further including an apparatus for releasably securing said plug to said sleeve.

3. An elbow fuseholder according to claim 2, wherein said apparatus includes a metal contact attached to said sleeve and releasable securement members selected from the group consisting of threads, twist locks and external clamps.

4. An elbow fuseholder according to claim 1, wherein said plug includes a contact said fuse includes a ferrule, said plug contact and fuse ferrule being detachably connected.

5. An elbow fuseholder according to claim 4, wherein said plug contact and said fuse ferrule are detachably connected by connection members selected from the group consisting of setscrews, elbow probe thread clamps and threads.

6. An elbow fuseholder according to claim 4, wherein said insulative sleeve includes a cable conductor contact adjacent said cable entrance.

7. An elbow fuseholder according to claim 6, wherein said cable conductor contact is connected to a fuse ferrule by securement members selected from the group consisting of garter springs, louvers, and pins and sockets.

8. An elbow fuseholder according to claim 1, wherein said insulative sleeve adjacent said cable entrance includes a cable adapter capable of receiving cables of different outer diameters.

9. An elbow fuseholder according to claim 1, wherein said insulating sleeve is molded rubber.

10. An elbow fuseholder according to claim 1, wherein said sleeve and said elbow interface are joined at a substantially right angle.

11. An elbow fuseholder, comprising:

a housing including a generally elongate insulative sleeve defining at one end thereof a cable entrance for receipt of a cable therein and at the opposing end a fuse entrance opening;

an elbow interface joined to said sleeve at an angle and defining a mating interface for electrical connection with an external bushing insert;

a fuse electrically connected at one end to a conductor of said cable received in said sleeve and electrically connected at another end to said elbow mating interface;

an insulating tube disposed interiorly of said insulative sleeve, said fuse being slidably supported interiorly therein; and a plug removably supported by said insulative sleeve at said fuse entrance opening and affixed to said fuse adjacent said elbow mating interface, said plug including a contact thereon in electrical connection with said fuse at said elbow mating interface, said plug, said contact and said fuse being jointly removable from said sleeve through said fuse opening upon removal of said plug from said sleeve.

12. An elbow fuseholder according to claim 1, further including an apparatus for releasably securing said plug to said sleeve.

13. An elbow fuseholder according to claim 12, wherein said fuse includes a ferrule, said plug contact and said fuse ferrule being detachably connected.

14. An elbow fuseholder, comprising:

a housing including a generally elongate insulative sleeve defining at one end thereof a cable entrance for receipt of a cable therein and at the opposing end a fuse entrance opening;

an elbow interface joined to said sleeve at an angle and defining a mating interface for electrical connection with an external bushing insert;

a fuse having at one end a first projecting ferrule electrically connected to a conductor of said cable received in said sleeve and at another end a second projecting ferrule electrically connected to said elbow mating interface, said first ferrule being releasably received within a cable contact secured to said cable conductor;

an insulating tube disposed interiorly of said insulative sleeve, said fuse being slidably supported interiorly therein; and a plug removably supported by said insulative sleeve at said fuse entrance opening and affixed to said fuse adjacent said elbow mating interface, said plug and said fuse being jointly removable from said sleeve through said fuse opening upon removal of said plug from said sleeve.

15. An elbow fuseholder according to claim 14, wherein said insulating tube has a length extending substantially from said first ferrule to said second ferrule.

16. An elbow fuseholder according to claim 15, wherein said insulative sleeve adjacent said cable entrance includes a separate cable adapter capable of receiving cables of different outer diameter.

17. An elbow fuseholder according to claim 16, wherein said cable adapter is supported in engagement with said insulating tube and receives said cable contact therein.

* * * * *